United States Patent [19]

Barrows

[11] 4,044,520

[45] Aug. 30, 1977

[54] BUILDING PANEL

[75] Inventor: Albert G. Barrows, West Haven, Conn.

[73] Assignee: John P. Bogiovanni, Chester, Conn.

[21] Appl. No.: 597,659

[22] Filed: July 21, 1975

[51] Int. Cl.[2] ..... E04C 2/10

[52] U.S. Cl. ..... 52/309.12; 52/453; 52/592; 428/192

[58] Field of Search ..... 52/309, 593, 453, 592, 52/309.8, 309.12; 428/163, 192, 315

[56] References Cited

U.S. PATENT DOCUMENTS

| | | | |
|---|---|---|---|
| 1,156,753 | 10/1915 | Carey | 52/593 |
| 3,239,479 | 3/1966 | Roenicke | 52/309 |
| 3,740,914 | 6/1973 | Diez | 52/392 |
| 3,853,577 | 12/1974 | Nishida | 52/309 |

FOREIGN PATENT DOCUMENTS

| | | | |
|---|---|---|---|
| 961,536 | 6/1964 | United Kingdom | 52/309 |

*Primary Examiner*—John E. Murtagh
*Attorney, Agent, or Firm*—McCormick, Paulding & Huber

[57] ABSTRACT

The panel includes a square base of expanded polystyrene, and has two projecting sides which mate with the undercut sides of two identical adjacent panels. All four sides of the base are bevelled slightly, and the front face defines intersecting grooves so that a polymer fortified concrete facing can be applied to the front of the base without warping the base as the concrete shrinks during hardening. An acrylic binder, with quartz granules carried thereon is provided over the concrete facing to enhance the appearance of the panel, and to improve its resistance to impact.

13 Claims, 7 Drawing Figures

FIG. 1
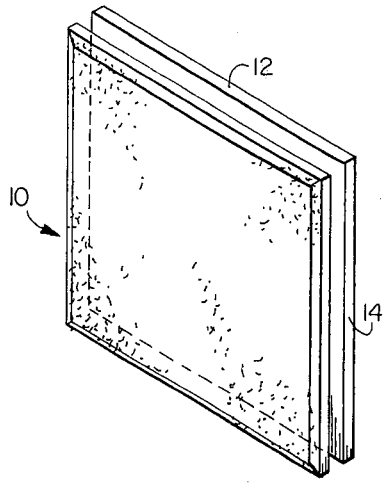
FIG. 2
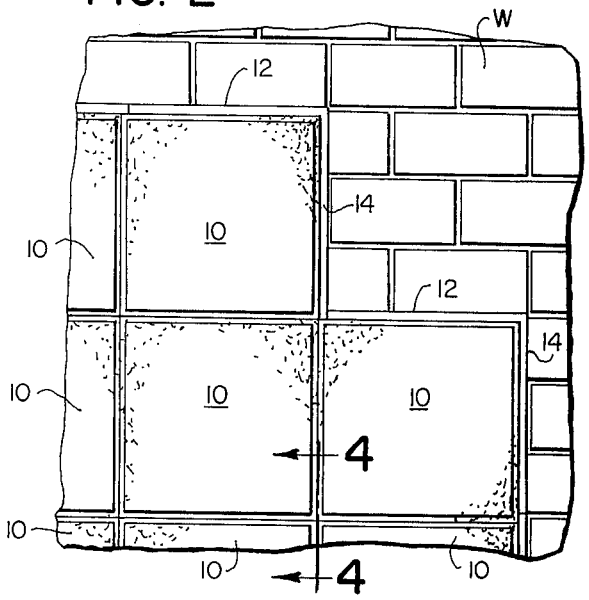
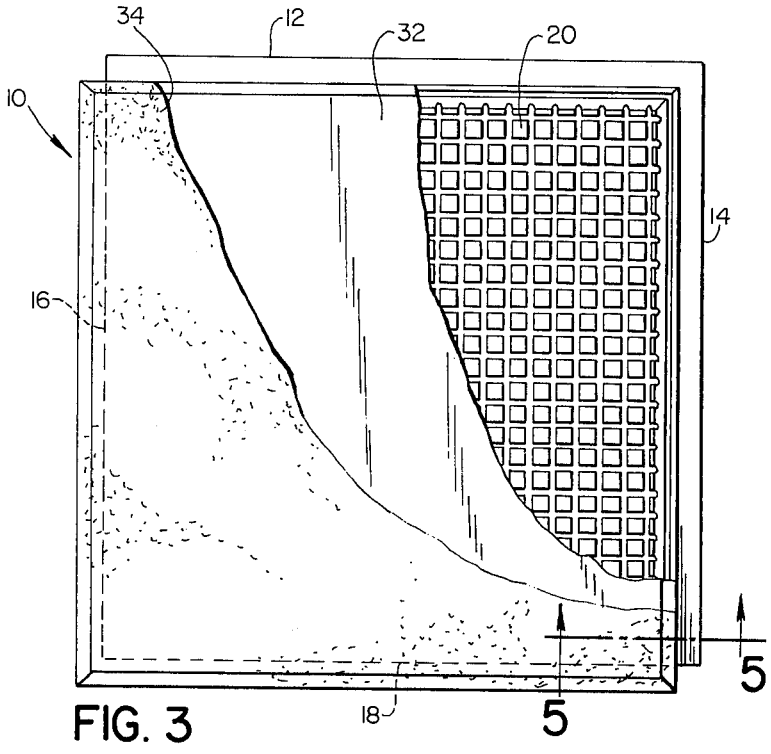
FIG. 3
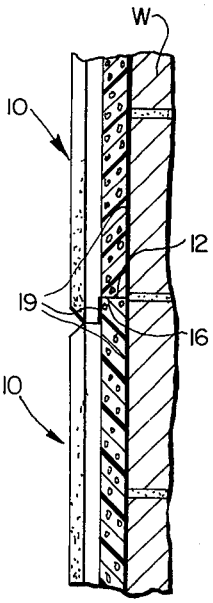
FIG. 4

BUILDING PANEL

SUMMARY OF INVENTION

This invention relates generally to building panels, and deals more particularly with a light-weight building panel with superior heat insulating properties, which panel is especially well-suited for use on a structural wall for further insulating the wall, and to improve the appearance of such wall, all at considerably lower cost than is presently possible with conventional brick veneering or the like.

A building wall panel incorporating the present invention comprises a system of interfitting, shiplapped panels, each of which panels has a base of expanded polystyrene or other material of equal heat insulating properties. Each such panel base further includes a building facing of polymer fortified concrete, which facing is formed directly on the front face of the panel base. The front face of the panel base defines intersecting grooves which are filled with the concrete facing material, thereby forming ribs of concrete which serve to prevent warping of the base as the concrete shrinks during the hardening process and adding to the strength of the panel without significantly increasing it's weight. Finally, another feature of the novel building panel comprises the application of quartz granules in an acrylic binder to the concrete facing so that the panel is not only an efficient insulator, but so that the panel is also provided with a distinctive appearance, the uses of which panel are only limited by the imagination of the architect. Further, the acrylic binder provides the panel with an improved resistance to impact far beyond that possible with the use of the polymer fortified concrete facing by itself.

BRIEF DESCRIPTION OF THE DRAWINGS

FIG. 1 is a perspective view of a building panel incorporating the present invention.

FIG. 2 is a view showing a plurality of panels such as that shown in FIG. 1, and also shows a block structural wall to which several panels have been mounted.

FIG. 3 is a plan view of one of the panels illustrated in FIG. 2, but with portions of the facing portions of the panel being broken away to reveal the structural makeup of said panel.

FIG. 4 is a sectional view taken generally on the line 4—4 of FIG. 2, but drawn to a slightly larger scale to better illustrate the panel's shiplapped structure.

FIG. 7 is a view similar to FIG. 6 but illustrating the use of a jam molding of the type for finishing the panel system in the area of a window or the like.

DETAILED DESCRIPTION

Figure 5:
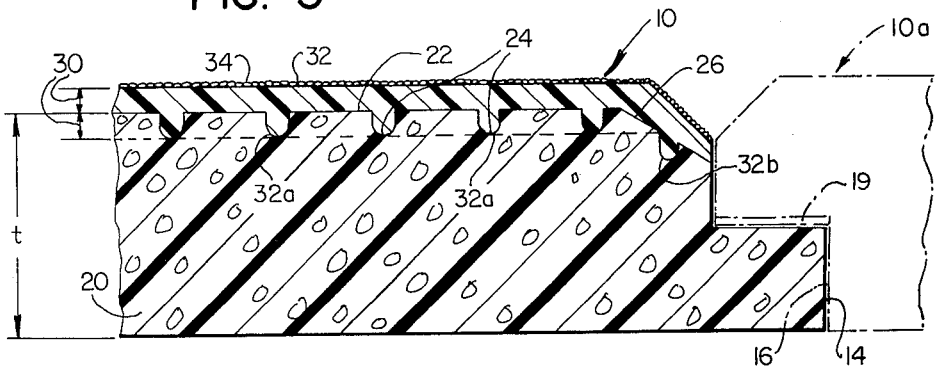
FIG. 5 is a sectional view taken generally on the line 5—5 of FIG. 3, but drawn to a somewhat larger scale to better illustrate the panel's cross sectional construction.

Turning now to the drawings in greater detail, FIG. 1 shows a single square panel 10 incorporating the present invention, and such panel includes a bevelled front face, and also includes two projecting edges 12 and 14 adapted to mate with the undercut edges of two indentical adjacent panels to form a wall system of the type suggested in FIG. 2.

FIG. 2 shows a structional block wall W, which wall is adapted to be provided with a plurality of panels of the type illustrated in FIG. 1 in order to decorate the otherwise bland block wall, and more significantly to insulate the wall as a result of the unique panel construction to be described hereinbelow. The panel system to be described also serves to waterproof the wall as a result of the shiplapped edges, and the unique facing for the panel provides considerable protection for the resulting wall both in terms of its resistance to temperature changes and also in terms of its durability as a result of its high impact resistance. In addition, the wall system is of economical construction and is very light in weight as a result of which it can be quickly and easily applied at a cost far less than brick veneer for example. The panels are readily attached to any existing wall such as that shown in FIGS. 2 and 4. A thixotrophic waterproof adhesive 19 can be used for this purpose.

The panels are illustrated is being square, and are preferably 24 inches on a side, but it will of course be understood that other regular polygonal configurations might be adopted, and that the size is not critical to the design concept described and claimed herein. However, the weight of the panels is such that a panel of 24 inches on a side, and slightly over 2 inches thick, is of a convenient size and weight for easy handling in the process for applying the wall system to a structural wall as suggested in FIGS. 2 and 4.

Turning now to a more detailed description of the construction for a single building panel of the type referred to above, FIG. 3 illustrates such a panel in plan view, the shiplapped edges being defined by the projections 12 and 14 on the upper and right hand sides of the panel, and the cavities 16 and 18 for receiving the corresponding projections for adjacent panels also being illustrated in this view. FIG. 5, taken generally on the sectional line 5—5 of FIG. 3, illustrates the cross sectional construction of the building panel described and claimed herein, and FIG. 5, also shows in phantom lines an adjacent panel 10*a* so as to further illustrate the manner of shiplapping adjacent panels to provide a waterproof and an effective thermal resistant barrier, well adapted to insulate and protect an exterior building wall. The adhesive 19 used to apply the panels to the wall W can also be applied to the panel joint as indicated in FIGS. 4 and 5.

With particular reference to FIG. 3, the building panel comprises a base 20 which is preferably fabricated of a light-weight material having exceptional thermal heat transfer resistance, such characteristics being true of expanded polystyrene, sold by several suppliers under various trademarks in both its expanded and pellet form (STYROFOAM and PLASTIFOAM). Such a material is presently preferred due to another characteristic, that is its relatively low cost. As shown in FIG. 5 the base 20 has a significant thickness *t*, which thickness may be on the order of 2 inches in order to achieve a workable trade off between the panel's size and cost, as compared to its heat insulating properties. While the thicker the panel, the more the latter property is enhanced, the more costly and bulky the panel becomes. Hence, the 2 inche thickness has been found to be an acceptable compromise between these competing requirements.

The panel base 20 may either be formed in the cavity of a suitable molding machine, or may be cut from slabs of expanded polystyrene material, as for example by cutting with a hot wire process. From the point of view of the present invention, it is especially important to note that the outer face 22 of the base 20 is provided with a plurality of mutually perpendicular intersecting grooves 24,24 and the outermost groove is provided more particularly in the bevelled portion 26 of the base 20 as shown in FIGS. 3 and 5. These grooves are preferably on the order of ¼ inch deep, and may be approximately 3/16 of an inch in width. The mutually perpendicular pattern of grooves illustrated in FIG. 3 may be so spaced that the planar area between these grooves is on the order of 1 square inch. While these dimensions are hot critical to the present invention in and of themselves, the depth of the grooves is regarded as being critical in the light of the thickness of a polymer fortified concrete facing 32 applied to the base. The said facing 32 preferably has a thickness on the order of ¼ inch, or more particularly on the same order of magnitude as the depth of the grooves themselves. For the best results, this thickness preferably lies in the range between ⅛and ½ inch. As best shown in FIG. 5 this thickness equivalency is indicated generally at 30,30.

Turning next to a description of the facing 32 for the panel 10, such facing preferably comprises a cementitious material and more particularly a polymer fortified concrete material applied to the panels such as that indicated generally by reference numeral 30 in FIG. 5, which depth is preferably on the order of 3/16 to ¼ of an inch, but could conceivably take the form of a minimal ⅛ inch depth or maximum ½ inch depth depending upon the overall geometry of the panel itself. However, in it's presently preferred form, that is with a square panel approximately 24 inches on a side, this thickness 30 is preferably between 3/16 and ¼ of an inch (exclusive of the ribs 32*a, 32a* formed in the grooves 24,24). In preparing the polymer fortified concrete mixture for application to the front face of the base 20, Portland cement is mixed with a number of graded aggregates. A plasticizer is used to provide the mix with the desired plasticity. The polymer fortification is provided by an acrylic base material together with a defoaming agent. The acrylic material is preferably water soluble and may be of the type sold by Rohm and Haas under their identification No. MC76. The presently preferred defoaming agent is sold by Diamond Chemical under their NXZ mark. This mix is applied to the front face of the panel base 20, to the depth indicated in FIG. 5, and allowed to harden. Upon curing or hardening, the depending ribs 32*a, 32a* formed in the grooves 24, 24 not only serve to anchor the facing 32 to the underlying base 20, but more importantly, serve to prevent warping of the relatively incompressible expanded polystyrene base material as the concrete facing 32 hardens. Normal shrinkage of concrete is such that without these depending ribs 32*a, 32a,* provided in the base 20, the considerably stronger concrete facing would result in a significant degree of warping of the panel base 20 such that it would be unsuitable for the purpose intended.

As shown in FIG. 5 the bevelled edge of the panel 10 is provided with a bevelled facing portion as well, and this facing portion is also provided with a depending rib 32*b*, and it will be noted, further, that the bevelled facing portion overchanges the bevelled edge of the base 20 as well, thereby serving to anchor the facing to the base, and more significantly serving to aid in preventing warping of the base material 20 as the concrete hardens or cures.

The facing material 32 described above has considerable strength in and of itself, but in order to further improve its impact resistance, and also to improve its appearance, quartz particles are provided in an acrylic binder on the facing 32. The same acrylic material might be utilized for such a binder as is provided in the concrete fortification material mentioned previously. The thickness of this binder material in the quartz particle layer is only on the order of 1/16, including the quartz granules, and a coagulating agent is preferably included with the acrylic binder in this outer layer so as to permit control of the viscosity of the material in which the granules are placed. Acrysol sold by Rohm and Haas under its trademark G110 is the presently preferred ingredient for accomplishing this variable viscosity. The quartz granules in the acrylic binder of this outer layer are preferably identical to those now prepared and sold for use in the fabrication of asphalt type roof shingles. Thus, these quartz granules are economically available, in a variety of colors. so as to permit fabrication of the panel system of the present invention in a single distinctive color, or in a pattern or two or more colors to produce any desired design. The use of this acrylic outer layer with its associated quartz particles or granules not only provides a panel of improved appearance, but also provides an impact resistant panel, the acrylic binder giving the panel much greater resistance to impact damage than a conventional concrete building panel. A building panel of the present invention, without the application of such an outer layer of acrylic and quartz particles, does not exhibit the same degree of impact resistance as does such a panel with this decorative outer layer. It should be noted that quartz granules are the presently preferred aggregate for the layer 32, but that other "stonelike" granules might also be utilized within the scope of the present invention.

Figure 6:
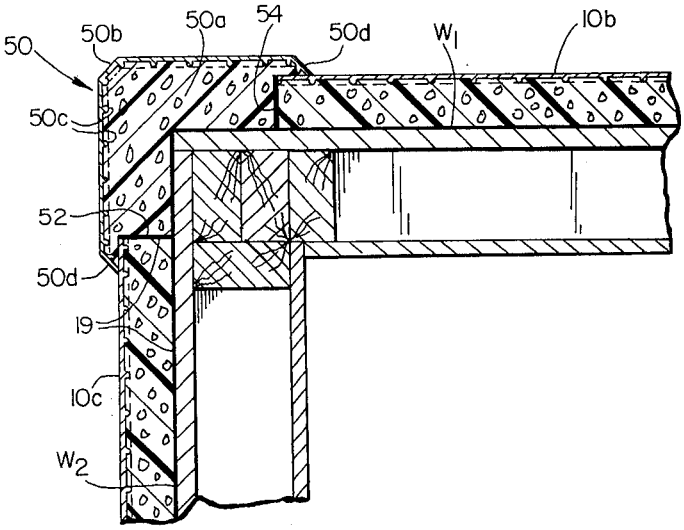
FIG. 6 is a horizontal sectional view through a corner of a wood frame structure illustrating a corner molding suitable for use with the building panel system of the present invention.

FIG. 6 illustrates a further refinement of the present invention whereby a corner molding 50 is provided at the corner of a frame wall $W_1$ which frame wall is fitted with a plurality of panels, 10*b* and 10*c*, of the type described hereinabove. These panels may be cut at the edges 52, 54, and overlying edges 50*d* serve to hide these cut edges. The corner molding 50 may be fabricated in a manner analagous to that described above with reference to the panels 10, 10, and such corner molding 50 preferably includes a core portion 50*a* , which is covered by a facing of polymer fortified concrete 50*b* applied to the front face of the core or base portion 50*a* by virtue of ribs 50*c, 50c* defined in the concrete facing material as a result of grooves having been first formed in the underlying core or base portion of said molding. Since the corner molding 50 is typically longer than the side of a typical panel 10, the front faces of the molding also define laterally extending cross ribs (indicated by the broken lines in FIG. 6) to prevent warping of the concrete facing material 50*b* in the bending mode where the greatest deflections are likely to be encountered during molding or curing of the facing material 50*b*. As with the panels, 10, 10 described previously, an outer skin or layer of acrylic and quartz granules is applied over the fortified concrete material 50*b,* and this impact resistant layer is especially important at the outside corner of the building because of the greater likelihood of damage to the structure at such a corner.

Figure 7:
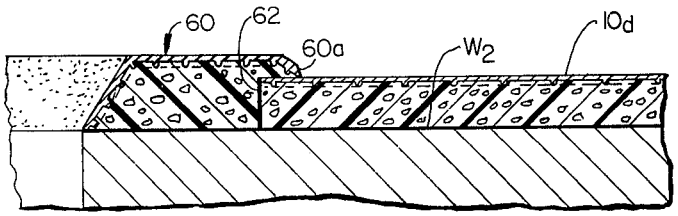

FIG. 7 shows a molding 60 of the type suitable for use at a window or door jamb, and which is fabricated by following a procedure similar to that outlined hereinabove with reference to the FIG. 6 corner molding 50.

The panel 10*d* may be cut at the edge indicated generally by reference numeral 62, and the overlying portion 60*a* of the molding 60 covers this edge. The jamb molding 60 includes a concrete facing which is bonded to the expanded polystyrene base in a manner similar to that described above and reference to the corner molding 50. So too, an outer layer of acrylic binder and quartz granules is preferably provided on this fortified concrete facing for the reasons mentioned previously. It should perhaps be noted that both the corner molding 50 and the jamb molding 60 are applied to an underlying structive wall $W_1$ and $W_2$ respectively by use of a conventional adhesive 19, which adhesive is also applied to the area of the joints in order to provide an effective moisture barrier.

From the foregoing description of the presently preferred embodiments of my invention it will be apparent that the front face of a panel or molding member can be conveniently constructed to produce a panel of the present invention. Such a panel is well-adapted to be assembled with a structure which may comprise a concrete block wall as suggested in FIG. 2, or other type structural wall as suggested in FIGS. 6 and 7. However, it should be noted that the rear face of my building panel might also be adapted for attachment to a variety of structures and should not be construed as being limited to attachment to a solid wall structure. For example, the building panels described herein could readily be adapted for attachment to a more skeleton like framework structure, such as might expose the rear panel face to the interior of a building structure. In such case, it is within the scope in my invention that the rear face also be provided with a facing of the type described with reference to the front facing 32, and/or acrylic layer or the like to enhance and protect the underlying panel.

I claim:

1. An exterior wall panel adapted for assembly with other similar panels, and comprising a base of heat insulating material, said base having a generally regular polygonal configuration and having at least one side defining a projecting edge adapted to mate with a cavity defined in the adjacent side of an identical adjacent panel, said base having a rear face adapted for attachment to a structure or the like, and having a front face defining grooves oriented generally perpendicularly with respect to said projecting edge, and a polymer fortified cementitious facing on said front face of said base, said facing having a thickness in the range of $\frac{1}{8}$ to $\frac{1}{2}$ inch, said facing including rearwardly projecting ribs integrally formed in the facing which ribs fill said grooves in the base to a depth at least as great as that of said facing thickness, and a layer of polymer material adhered to the facing, said front face of said base has a bevelled edge, and wherein said facing also includes a bevelled edge such that an overhanging portion of the facing projects inwardly thereof to further reinforce the base.

2. The exterior wall panel defined in claim 1 wherein said base is fabricated of an expanded polystyrene material.

3. The exterior wall panel of claim 1 further characterized by particles of stonelike consistency provided in said polymer material.

4. An exterior wall panel as defined in claim 1 wherein said regular polygonal configuration comprises a rectangular shape with at least one pair or adjacent sides of the rectangle defining said projecting edges, the other two adjacent sides defining complementary cavities for receiving the projecting edges of said adjacent panel.

5. The exterior wall panel defined in claim 1 wherein said regular polygonal configuration of said panel comprises a square equilateral shape with two adjacent sides defining said projecting edges and the other two adjacent sides defining complementary cavities for receiving the projecting edges of said adjacent panels.

6. The exterior wall panel defined in claim 4 wherein an additional set of grooves are oriented perpendicular to one of said cavity defining edges and perpendicular said first set of grooves oriented perpendicular said projecting edge whereby all of said grooves intersect one another in a grid like pattern.

7. An exterior wall panel adapted for assembly with other similar panels, and comprising a base of heat insulating material said base having a generally regular polygonal configuration and having at least one side defining a projecting edge adapted to mate with a cavity defined in the adjacent side of an identical adjacent panel, said base having a rear face adapted for attachment to a structure or the like, and having a front face defining grooves oriented generally perpendicularly with respect to said projecting edge, and a polymer fortified cementitious facing on said front face of said base, said facing having a thickness in the range of $\frac{1}{8}$ to $\frac{1}{2}$inch, said facing including rearwardly projecting ribs integrally formed in the facing which ribs fill said grooves in the base to a depth at least as great as that of said facing thickness, and a layer of binder material adhered to the facing, and granules entrained in said layer.

8. The exterior wall panel of claim 7 wherein said binder material comprises an acrylic compound, and wherein said granules comprise an aggregate of stonelike consistency.

9. An exterior wall panel adapted for assembly with other similar panels, and comprising a base of heat insulating material, said base having a generally regular polygonal configuration and having at least one side defining a projecting edge adapted to mate with a cavity defined in the adjacent side of an identical adjacent panel, said base having a rear face adapted for attachment to a structure or the like, and having a front face defining grooves oriented generally perpendicularly with respect to said projecting edge, and a polymer fortified cementitious facing on said front face of said base, said facing having a thickness in the range of $\frac{1}{8}$ to $\frac{1}{2}$ inch, said facing including rearwardly projecting ribs integrally formed in the facing which ribs fill said grooves in the base to a depth at least as great as that of said facing thickness, said front face of said base has a bevelled edge, and wherein said facing also facing projects inwardly thereof to further reinforce the base and said bevelled edge including a concave or grooved portion, said bevelled edge of said facing being of complementary convex cross section.

10. The exterior wall panel defined in claim 9 wherein an additional set of grooves are oriented perpendicular to one of said cavity defining edges and perpendicular said first set of grooves oriented perpendicular said projecting edge whereby all of said grooves intersect one another in a grid like pattern.

11. The exterior wall panel defined in claim 10 wherein said base bevelled edges all include concave or grooved portions, and said bevelled edge of said facing being of complementary convex cross section.

12. The exterior wall panel of claim 9 further characterized by a layer of polymer material adhered to the facing.

13. The exterior wall panel of claim 9 further characterized by a layer of binder material adhered to the facing, and granules entrained in said layer.

* * * * *

UNITED STATES PATENT OFFICE

CERTIFICATE OF CORRECTION

Patent No. 4,044,520 Dated August 30, 1977

Inventor(s) Albert G. Barrows

It is certified that error appears in the above-identified patent and that said Letters Patent are hereby corrected as shown below:

Col. 1, line 58, "jam" should be --jamb--.

Col. 2, line 19, "is" should be --as--.

Col. 2, line 62, "inche" should be --inch--.

Col. 3, line 12, "hot" should be --not--.

Col. 3, line 30, "it's" should be --its--.

Col. 4, line 14, after "viscosity" insert --feature--.

Col. 4, line 18, after "colors" delete --.--.

Col. 4, line 57, "molding" should be --hardening--.

Col. 5, line 6, "and" should be --with--.

Col. 5, line 12, "structive" should be --structure--.

Col. 5, line 32, after "and/or" insert --with an--.

UNITED STATES PATENT OFFICE

CERTIFICATE OF CORRECTION

Patent No. 4,044,520 Dated August 30, 1977

Inventor(s) Albert G. Barrows

It is certified that error appears in the above-identified patent and that said Letters Patent are hereby corrected as shown below:

Col. 6, line 48, after "said facing also" insert -- includes a bevelled edge such that an overhanging portion of the --.

Signed and Sealed this

Fourth Day of April 1978

[SEAL]

Attest:

RUTH C. MASON
Attesting Officer

LUTRELLE F. PARKER
Acting Commissioner of Patents and Trademarks